US007549561B2

(12) United States Patent
Kirby et al.

(10) Patent No.: US 7,549,561 B2
(45) Date of Patent: Jun. 23, 2009

(54) STAPLER WITH IMPROVED BASE CONSTRUCTION

(75) Inventors: David W. Kirby, Lemont, IL (US); Robert C. Coon, Chicago, IL (US); Stephen J. Gaynes, McHenry, IL (US)

(73) Assignee: Acco Brands USA LLC, Lincolnshire, IL (US)

( * ) Notice: Subject to any disclaimer, the term of this patent is extended or adjusted under 35 U.S.C. 154(b) by 0 days.

(21) Appl. No.: 11/192,325

(22) Filed: Jul. 29, 2005

(65) Prior Publication Data

US 2006/0144894 A1 Jul. 6, 2006

Related U.S. Application Data

(63) Continuation-in-part of application No. 29/202,700, filed on Apr. 2, 2004, now Pat. No. Des. 511,665.

(51) Int. Cl.
*B25C 5/11* (2006.01)

(52) U.S. Cl. ..... 227/120; 227/134; 227/156

(58) Field of Classification Search ..... 227/120, 227/109, 132, 134, 136, 156; D8/50
See application file for complete search history.

(56) References Cited

U.S. PATENT DOCUMENTS

| | | | | |
|---|---|---|---|---|
| 2,028,350 | A | 1/1936 | Polzer | |
| D110,801 | S | 8/1938 | Crosby | |
| 2,233,958 | A * | 3/1941 | Obstfeld et al. | 227/126 |
| D127,378 | S | 5/1941 | Pankonin | |
| 2,251,915 | A | 8/1941 | Crosby | |
| 2,499,432 | A * | 3/1950 | Von Cseh | 227/120 |
| D170,423 | S | 9/1953 | Marano | |
| 2,658,197 | A | 11/1953 | Pankonin | |
| D173,959 | S | 2/1955 | Marano | |
| 2,717,382 | A | 9/1955 | Ruskin | |
| 2,726,392 | A | 12/1955 | Marano | |
| 2,801,414 | A * | 8/1957 | Mueller | 227/127 |
| D186,342 | S | 10/1959 | Marano | |
| 2,941,208 | A | 6/1960 | Marano | |
| D191,290 | S | 9/1961 | Belbow | |
| 3,083,367 | A * | 4/1963 | Ruskin | 227/125 |
| 3,630,428 | A | 12/1971 | Olney et al. | |
| 3,656,678 | A | 4/1972 | Ruskin | |

(Continued)

OTHER PUBLICATIONS

Acco Brands, Inc., Fact Book 2001, Feb. 1, 2001, pp. 178-186.

(Continued)

*Primary Examiner*—Rinaldi I. Rada
*Assistant Examiner*—Nathaniel Chukwurah
(74) *Attorney, Agent, or Firm*—Michael Best & Friedrich LLP

(57) ABSTRACT

A stapler including a base having a first end, a second end, and opposite sides. A staple magazine is connected to the base for movement with respect to the base during stapling operations. A cover assembly is connected to the base. The first end of the base includes first and second hip portions such that the staple magazine and cover assembly are received within the hip portions. In some embodiments, the hip portions each include a cutout portion. In other embodiments, the hip portions each include a rib extending inwardly toward the magazine.

13 Claims, 4 Drawing Sheets

U.S. PATENT DOCUMENTS

D232,804 S 9/1974 Power
D233,306 S 10/1974 Power
3,889,865 A * 6/1975 Kuypers ..... 227/109
3,907,190 A 9/1975 Mitsuhashi
D243,148 S 1/1977 Levin
4,240,572 A 12/1980 Mitsuhashi
4,463,890 A 8/1984 Ruskin
D277,162 S 1/1985 Power et al.
4,666,075 A 5/1987 Olesen
D296,071 S 6/1988 Chi
D296,183 S 6/1988 Chi
D301,677 S 6/1989 Rosenblad
D314,897 S 2/1991 Hung
D331,178 S 11/1992 Bain
D340,847 S 11/1993 Bain
D352,435 S * 11/1994 Chi ..... D8/50
D354,209 S 1/1995 Haluska
5,690,268 A 11/1997 Evans et al.
D392,528 S 3/1998 Rossetto et al.
D394,194 S 5/1998 Brunsdon
D394,592 S 5/1998 Brunsdon
5,797,535 A 8/1998 Lovegrove et al.
D406,996 S 3/1999 Matthes
D411,423 S 6/1999 Huang
D411,725 S 6/1999 Matthes
D413,239 S 8/1999 Lovegrove et al.
D414,091 S 9/1999 Rellinger
D416,454 S 11/1999 Lovegrove et al.
D416,774 S 11/1999 Huang
5,979,734 A * 11/1999 Chang ..... 227/76
D420,266 S 2/2000 Berry et al.
D426,122 S * 6/2000 Wu ..... D8/50
D429,453 S 8/2000 Imboden et al.
6,152,347 A 11/2000 Wilson et al.
D436,010 S 1/2001 Nakamura
D437,754 S 2/2001 Jacquet
6,244,489 B1 * 6/2001 Laurie ..... 227/63
6,244,491 B1 6/2001 Kandasamy
D446,430 S 8/2001 Arns
D447,676 S 9/2001 Wilson et al.
6,371,349 B2 4/2002 Laurie
D465,139 S 11/2002 Robillard
D466,774 S 12/2002 Lee
D478,485 S 8/2003 Huang
D478,798 S 8/2003 Huang
6,662,991 B1 * 12/2003 Huang ..... 227/151
2001/0017310 A1 8/2001 Laurie
2003/0047581 A1 3/2003 Tanaka et al.

OTHER PUBLICATIONS

Acco Brands, Inc., Fact Book 2003, Feb. 1, 2003, pp. 98-107.

* cited by examiner

STAPLER WITH IMPROVED BASE CONSTRUCTION

RELATED APPLICATIONS

This application is a continuation-in-part of U.S. patent application Ser. No. 29/202,700, filed Apr. 2, 2004, now U.S. Pat. No. D,511,665 the entire contents of which are incorporated by reference herein.

FIELD OF THE INVENTION

The invention relates to staplers, and more specifically to a stapler base construction.

BACKGROUND OF THE INVENTION

Staplers are known to have bases with varying configurations. For example, some desktop staplers have a flat base including a rubber slipper such that the stapler sits flat on a desk or other surface. Other staplers are designed to be picked up and gripped by the user during the stapling operation, and may include flat nose pieces so that the stapler stands vertically upright. In staplers that are designed to be gripped by the user, it is desirable to provide a stapler having an overall geometry that makes it easier for the user to grip and use the stapler, while also maximizing support and guidance of the stapler to provide for more accurate stapling.

SUMMARY OF THE INVENTION

The present invention includes a stapler having a base having a first end, a second end, and opposite sides, a staple magazine connected to the base for movement with respect to the base during stapling operations, and a cover assembly connected to the base. The first end of the base includes first and second hip portions such that the staple magazine and cover assembly are received within the hip portions. The hip portions include a cutout portion therein.

In one embodiment, the first and second hip portions have a length that is greater than or equal to about 40% of the length of the magazine, and less than or equal to about 80% of the length of the magazine. In another embodiment, the cutout portion extends through only a portion of each of the first and second hip portions, forming a recess therein. In yet another embodiment, the cutout portion extends completely through the first and second hip portions, forming an aperture through each of the first and second hip portions.

The invention also provides a stapler including a base having a first end, a second end, and opposite sides, the base having a length and a staple magazine connected to the base for movement with respect to the base during stapling operations. A cover assembly is connected to the base. The first end of the base includes first and second hip portions such that the staple magazine and cover assembly are received within the hip portions, the hip portions including a rib extending inwardly toward the magazine such that the magazine is received between the ribs. The hip portions have a length that is greater than or equal to approximately 40% of the length of the magazine, and is less than or equal to approximately 80% of the length of the magazine. In one embodiment, the ribs are spaced from the magazine such that the magazine can move between the ribs vertically with respect to the base without interference, but is constrained from moving laterally with respect to the base by the ribs.

Other features and advantages of the invention will become apparent to those skilled in the art upon review of the following detailed description and drawings.

Figure 1:
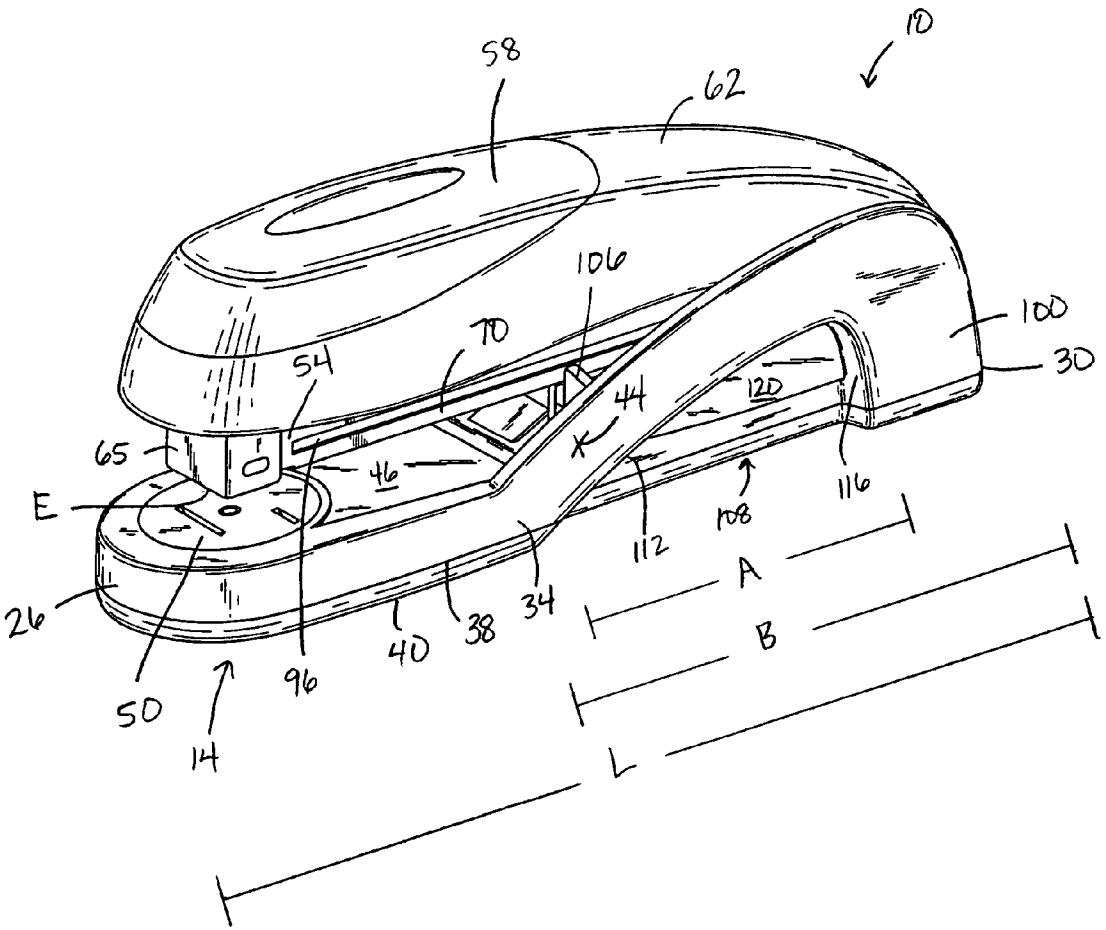
FIG. 1 is perspective view of a stapler embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items.

DETAILED DESCRIPTION

FIG. 1 illustrates a stapler 10 having a stapler base 14 embodying the present invention. It is to be understood that, while the illustrated stapler 10 is a manual, desktop-type stapler, the stapler base 14 of the invention can be practiced with almost any type of stapler, including, but not limited to, manual hand-held or upright staplers, manual heavy-duty staplers, and all forms of electric staplers, including desktop-type, heavy-duty, and hand-held electric staplers.

The illustrated stapler base 14 includes a front end 26, a rear end 30, and opposing sides 34. A bottom 38 of the base is at least partially covered by a slipper or pad 40 that helps stabilize and minimize sliding movement of the stapler 10 on a support surface (not shown), such as a desk. The stapler base 14 has a length L approximately equal to 186 mm, and defines a midpoint 44 of the stapler 10. It is understood that the stapler base 14 could have a length greater than or less than 186 mm and still fall within the scope of the present invention.

The base 14 further includes a top surface 46 for receiving and supporting a stack of sheets (not shown) to be stapled. An anvil 50 is supported by the top surface 46 for clinching staples driven through the stack of sheets. As used herein and in the appended claims, the terms "top", "bottom", "upper", "lower", "right", "left", "front", "rear", and the like are provided to facilitate description of the illustrated embodiments, and are not intended to imply or require any particular orientation.

Figure 2:
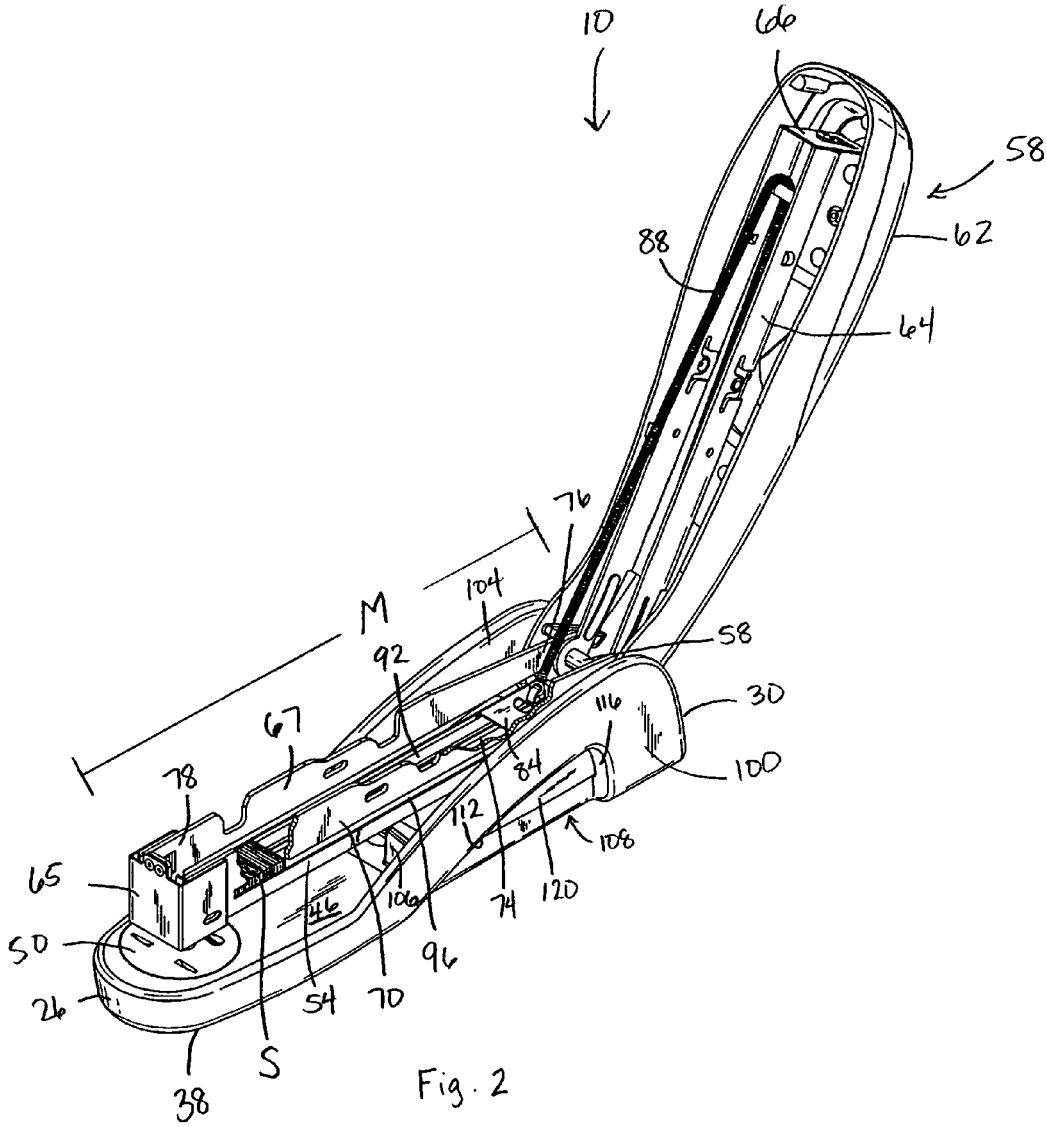
FIG. 2 is a perspective view of the stapler of FIG. 1 in the open position.

With reference to FIG. 2, a staple magazine 54 is pivotally connected to the rear end 30 of the base 14 about a pivot axis defined by a pivot shaft 58, as is understood in the art. The magazine 54 is configured to hold staples within the stapler 10. The magazine 54 has a length M greater than or equal to 120 mm, or between approximately 60% and 90% of the length L of the stapler base 14. In a preferred embodiment, the magazine 54 has a length between approximately 70% and 85% of the length of the base 14. In the illustrated embodiment, the length M of the magazine 54 is approximately equal to 150 mm, and thus is approximately equal to 80% of the length L of the stapler base 14.

A cover assembly 60 is also pivotally connected to the base 14, and is capable of pivoting both with the magazine 54 and with respect to the magazine 54 during stapling operations. The cover assembly 60 can be pivoted away from the magazine 54 to facilitate re-filling the magazine 54 with strips of staples S, as shown in FIG. 2. The cover assembly 60 includes an outer cover 62 that can be depressed by the user to actuate the stapler 10.

A case 64 is also pivotally connected to the base 14 about the pivot axis 58. The case 64 at least partially closes the upper portion of the magazine 54 when the cover 62 is in the closed position, and will pivot with the cover 62 to the open position for re-filling the magazine 54 with staples.

The stapler 10 also includes a driver 66 mounted to the case 64 to drive the staples S out of the stapler 10 into the stack of sheets. The front surface of the driver 66 defines a plane of movement in which the driver 66 moves downwardly to drive the staple S out of the stapler 10. When the cover assembly 60 is closed, the staple driver 66 is positioned directly above the staple ejection point E defined by the front of the magazine 54. The case 64 is pivotable with respect to the outer cover 62 such that the outer cover 62 and the staple driver 66 can move in a staple driving direction (downwardly) relative to the case 64.

The magazine 54 includes a nose piece 65, a first side wall 67 defining interior and exterior surfaces, and a second side wall 70 defining interior and exterior surfaces. The side walls 67, 70 are coupled together by a bottom wall 74, and are spaced apart a distance approximately equal to the width of the staples to be used with the stapler 10. The magazine 54 also includes a rear portion 76 that is pivotally connected to the rear end 30 of the base 14, and a front portion 78.

Staples S are inserted into the magazine 54 and are supported on the outside staple leg surfaces by the respective interior surfaces of the first and second side walls 67, 70 as the staples move through the magazine 54 in a known manner. As shown in FIG. 2, a staple pusher 84 is positioned within the magazine 54 and is biased toward the front of the magazine 54 to urge the strip of staples S toward the staple ejection point. In the illustrated embodiment, the staple pusher 84 is biased by a spring 88, but other biasing arrangements can also be used.

The illustrated magazine 54 also includes a rail 92 positioned between the side walls 67, 70 that supports the crown and the underside of the staples S, as well as supporting the staple pusher 84 within the magazine 54. In other embodiments, the rail 92 could be eliminated from within the magazine 54, as magazines without rails are well-known. The first and second side walls 67, 70 also include a channel 96 that further supports the outside of the staple legs when the staples S are in the magazine 54, though it is understood that in other embodiments, the magazine may not include this channel.

The rear end 30 of the base 14 includes a first hip portion 100 and a second hip portion 104. The first and second hip portions 100, 104 extend along either side of the rear end 30 of the base 14, and support the magazine 54 and cover assembly 60 therebetween. The first and second hip portions 100, 104 substantially mirror one another and thus any description of one of the hip portions applies to the other hip portion as well, unless otherwise noted.

Figure 3:
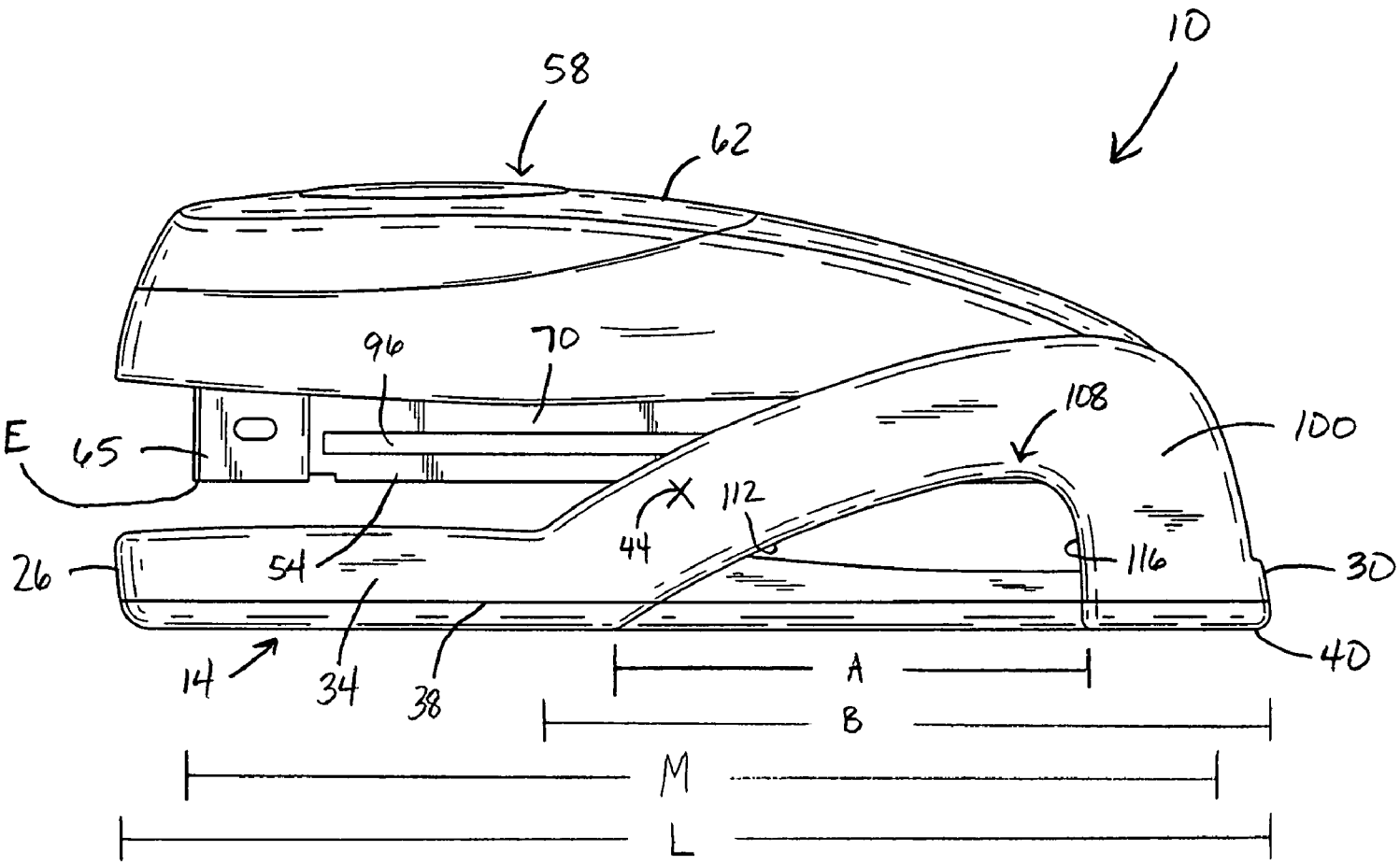
FIG. 3 is a side view of another stapler according to the present invention.

The first and second hip portions 100, 104 function to support and align the magazine 54 and cover assembly 60 when the user actuates the stapler 10. As shown in FIGS. 1 and 3, the hip portions 100, 104 preferably have a length B that is equal to between about 35% and 75% of the length L of the stapler base 14. In one preferred embodiment, the hip portions 100, 104 have a length that is equal to between about 45% and about 60% of the length of the base 14. In the illustrated embodiment, the hip portions 100, 104 have a length B of approximately 92 mm such that the hip portion 100 extends along approximately 50% of the length L of the stapler base 14.

Preferably, the hip portions 100, 104 have a length B that is greater than or equal to about 40% of the length M of the magazine 54 and less than or equal to about 80% of the length M of the magazine 54. In another preferred embodiment, the hip portions 100, 104 have a length that is greater than or equal to approximately 50% of the length of the magazine 54 and less than or equal to approximately 80%. In another preferred embodiment, the hip portions 100, 104 have a length that is greater than or equal to approximately 50% of the length of the magazine 54 and less than or equal to approximately 70%. In another preferred embodiment, the hip portions 100, 104 have a length that is greater than or equal to approximately 60% of the length of the magazine 54 and less than or equal to approximately 80%. The hip portions 100, 104 of the illustrated embodiment have a length B extending along approximately 61% of the length M of the magazine 54.

By extending the hip portions 100, 104 along a greater portion of the length of the stapler 10 (and, in particular, along a greater portion of the length of the magazine 54), the stiffness of the stapler base 14 is increased. Increasing the stiffness of the base assists in reducing the lateral movement of the magazine 54 and cover assembly 60 during stapling such that greater support of the magazine 54 and cover assembly 60 can be achieved during the stapling operation.

Figure 4:
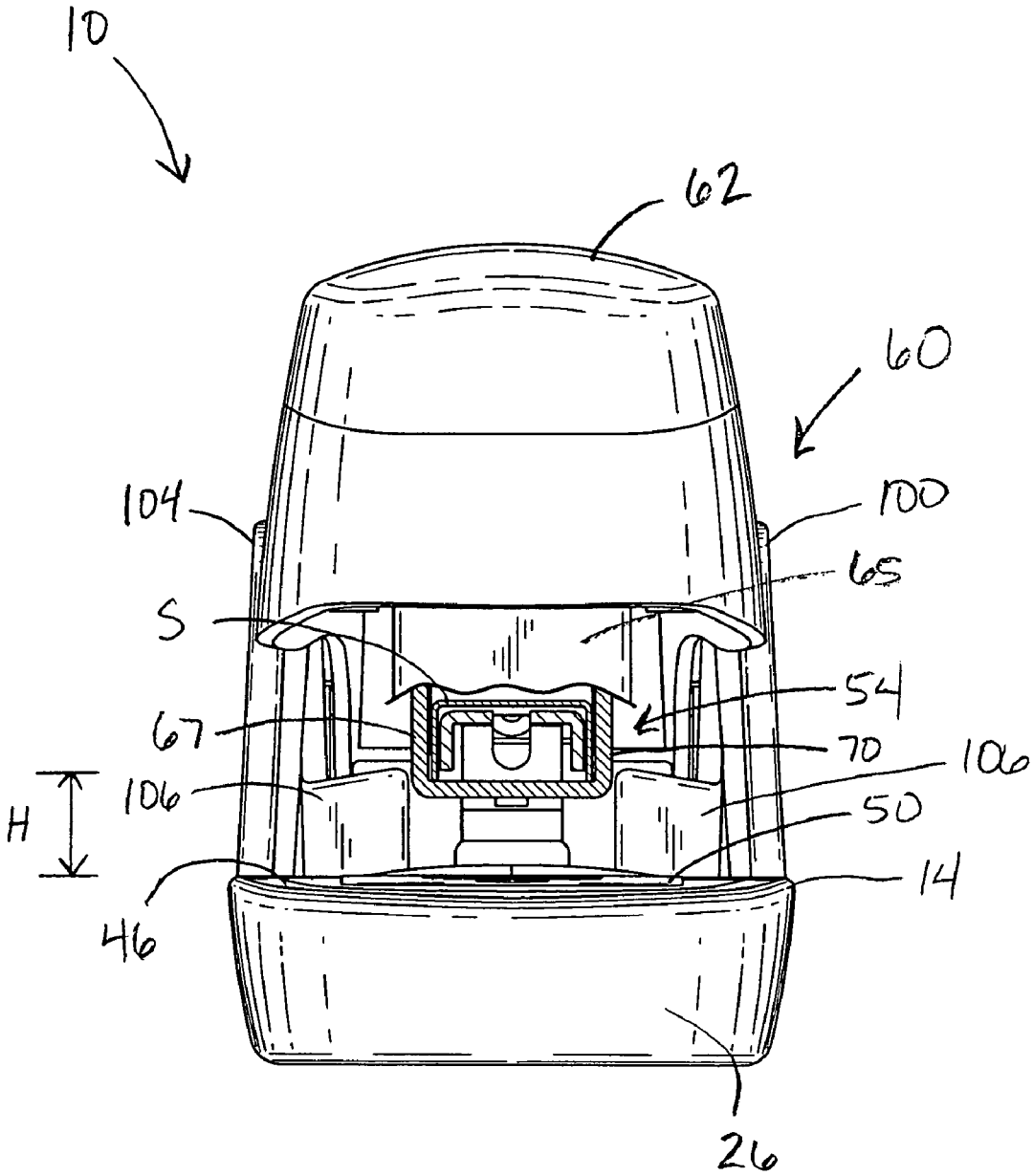
FIG. 4 is a front view of the stapler of FIG. 1, with a portion of the magazine cutaway.

The extended hip portions 100, 104 also provide alignment of the magazine 54 and cover assembly 60 (and thus, the driver 66) with the anvil 50 in the top surface 46 of the base. With reference to FIGS. 1 and 4, the hip portions 100, 104 each include a support rib 106 extending inwardly from the inner surface of the hip portion 100, 104 toward the magazine 54. With particular reference to FIG. 4, the ribs 106 have a height H that extends upwardly beyond the bottom wall 74 of the magazine 54 such that the sidewalls 67, 70 of the magazine 54 are constrained between the ribs 106. There is sufficient clearance between the ribs 106 and the sidewalls 67, 70 such that the magazine 54 can move between the ribs 106 vertically with respect to the base without interference from the ribs 106 as the magazine 54 pivots during stapling operations, but the clearance is close enough that the ribs 106 significantly reduce the possibility of misalignment of the magazine 54 with respect to the anvil 50 due to lateral movement of the magazine 54 during stapling operations by constraining lateral movement of the magazine 54 therebetween.

Thus, the ribs 106 also contribute to the improved alignment of the stapler 10. The improved alignment allows for more precise staple placement, and results in a higher sheet capacity for the stapler 10 as the stapler 10 experiences fewer failures based upon improper alignment and clinching of the staples S driven from the stapler 10.

Extending the hip portions 100, 104 along a greater portion of the length of the magazine 54 allows the ribs 106 to support and align the magazine 54 nearer the front of the magazine 54 (i.e., nearer the staple ejection point E). Supporting the magazine 54 nearer the staple ejection point increases the stiffness of the magazine 54 and further reduces the possibility of misalignment of a staple due to lateral movement of the magazine 54 by constraining the magazine 54 nearer the staple ejection point E.

The extended hip portions 100, 104 also function to shield the ribs 106 from the view of the user. It is desirable to many stapler users to have a stapler that is sleek, stylish, and simple in appearance, without any visual distractions from the overall appearance of the stapler from stapler components that otherwise add to the functionality and value of the stapler. With reference in particular to FIG. 3, the hip portions 100, 104 add to the aesthetic appearance of the stapler 10 by shielding the ribs 106 from the view of the user and contributing to a pleasing aesthetic appearance of the stapler 10.

As best shown in FIG. 1, the first hip portion 100 of the stapler 10 includes a cutout portion 108. The second hip portion 104 includes a second cutout portion (not shown) that is identical in configuration to the cutout portion 108, and thus the description of the cutout portion 108 applies to the second cutout portion as well.

The cutout portion 108 is an area in the hip portion 100 where an amount of the material that forms the stapler base 14 has been removed. Preferably, the cutout portion 108 has a length A that is between about 45% and 65% of the length B of the hip portion 100, and is between about 20% and 40% of the overall length L of the stapler base 14. The cutout portion 108 of the illustrated embodiment has a length A approximately equal to 52 mm. Thus, the length A of the cutout portion 108 is approximately equal to 57% of the length B of the hip portion 100, and is approximately equal to 28% of the overall length L of the stapler base 14.

In the embodiment of FIGS. 1 and 2, the cutout portion 108 includes side walls 112, 116 that are connected by a back wall 120 such that the cutout portion 108 is recessed back from the surface of the hip portion 100. In the embodiment shown in FIG. 3, the cutout portion 108 has no back wall such that the cutout portion 108 is an aperture extending through to the second hip portion 104 where all of the material forming the base 14 is removed from the cutout portion.

Removing material from the cutout portion 108, either forming the recess of FIGS. 1 and 2 or the aperture of FIG. 3, shifts the center of mass of the stapler 10 from the rear end of the stapler 10 towards the midpoint 44 of the stapler 10. By centering the mass of the stapler 10 at or near the midpoint 44, the ergonomics of the stapler 10 are improved.

When a user picks up a traditional stapler, the center of mass is at the rear of the stapler, while the user grips the stapler near the midpoint. This difference between the grip placement and center of mass can cause uncomfortable twisting and bending of the user's hand, as the heavier rear end of the stapler wants to fall towards the ground due to the force of gravity. Not only can this be uncomfortable to the user, it can also make performing the stapling operation more difficult in that the user must exert force to stabilize the stapler, thus taking force away from the performance of the stapling operation. If the user were to try and grip the rear of the stapler to support the center of mass of the conventional stapler, the stapling operation would be even more difficult, as the user would have difficulty applying the requisite force to the staple driver to perform the stapling operation from the rear hold.

In contrast, the stapler 10 of the illustrated embodiments has a center of mass at or near the midpoint 44 of the stapler 10, such that the center of mass is within the grip of the user. This reduces the twisting and bending of the user's hand, as the user is supporting the center of mass of the stapler 10. This also results in easier, more accurate stapling as all of the user's force can be directed into the driver 66 to perform staple driving function. Thus, the ergonomics of the stapler 10 are improved.

Various features of the invention can be found in the following claims.

We claim:

1. A stapler comprising:

a base having a rear end, a front end, and opposite sides, the base having a length;

a staple magazine connected to the base at a pivot point on the rear end for movement with respect to the base during stapling operations; and a cover assembly connected to the base;

wherein the rear end of the base includes first and second hip portions such that the staple magazine and cover assembly are received between the hip portions, the hip portions including a cutout having a length in a direction parallel to the length of the base between about 20% and about 40% of the length of the base, the entire cutout being positioned between the pivot point and the front end of the base.

2. The stapler of claim 1, wherein the first and second hip portions have a length that is greater than or equal to approximately 50% of the length of the base.

3. The stapler of claim 1, wherein the magazine has a length, and wherein the first and second hip portions have a length that is greater than or equal to approximately 40% of the length of the magazine, and less than or equal to approximately 80% of the length of the magazine.

4. The stapler of claim 3, wherein the first and second hip portions have a length that is greater than or equal to approximately 60% of the length of the staple magazine and less than or equal to approximately 80% of the length of the staple magazine.

5. The stapler of claim 1, wherein the cutout extends only through at least a portion of the first and second hip portions.

6. The stapler of claim 1, wherein the cutout extends through only a portion of each of the first and second hip portions, forming a recess therein.

7. The stapler of claim 1, wherein the cutout extends completely through the first and second hip portions, forming an aperture through each of the first and second hip portions.

8. The stapler of claim 1, wherein the first and second hip portions have a length, and wherein the length of the cutout is between about 45% and about 65% of the length of the first and second hip portions.

9. The stapler of claim 1, wherein the length of the cutout is approximately 28% of the length of the base.

10. The stapler of claim 1, wherein each of the first and second hip portions includes a rib extending inwardly toward the magazine.

11. The stapler of claim 10, wherein the ribs are spaced from the magazine such that the magazine can move between the ribs vertically with respect to the base without interference, but is constrained from moving laterally with respect to the base by the ribs.

12. The stapler of claim 1, wherein the stapler has a center of mass, and wherein the center of mass of the stapler is located at or near a midpoint of the stapler.

13. The stapler of claim 1, wherein a front end and a rear end of the cutout are each defined by a portion of the base that is configured to rest on a support surface.

* * * * *

UNITED STATES PATENT AND TRADEMARK OFFICE

CERTIFICATE OF CORRECTION

PATENT NO. : 7,549,561 B2
APPLICATION NO. : 11/192325
DATED : June 23, 2009
INVENTOR(S) : David W. Kirby et al.

It is certified that error appears in the above-identified patent and that said Letters Patent is hereby corrected as shown below:

On the Title Page, Item (56) in the References Cited:

change "D478,798" to --D478,797--

Signed and Sealed this

Fourth Day of August, 2009

John Doll

JOHN DOLL
*Acting Director of the United States Patent and Trademark Office*